US012305346B1

(12) United States Patent
Keigley

(10) Patent No.: US 12,305,346 B1
(45) Date of Patent: May 20, 2025

(54) SNOWPLOW HOOKUPS FOR WORK MACHINES

(71) Applicant: ABI ATTACHMENTS, INC., Mishawaka, IN (US)

(72) Inventor: Kevin V. Keigley, Osceola, IN (US)

(73) Assignee: ABI Attachments, Inc., Mishawaka, IN (US)

( * ) Notice: Subject to any disclaimer, the term of this patent is extended or adjusted under 35 U.S.C. 154(b) by 833 days.

(21) Appl. No.: 17/408,600

(22) Filed: Aug. 23, 2021

Related U.S. Application Data

(60) Provisional application No. 63/069,326, filed on Aug. 24, 2020.

(51) Int. Cl.
*E01H 5/04* (2006.01)
*E01H 5/06* (2006.01)

(52) U.S. Cl.
CPC ..... *E01H 5/06* (2013.01)

(58) Field of Classification Search
CPC ..... A01B 45/02; A01B 71/06; A01D 42/08; A01D 43/12; E01H 5/06; E01H 5/065
See application file for complete search history.

(56) References Cited

U.S. PATENT DOCUMENTS 5,082,065 A * 1/1992 Fletcher ..... A01B 71/06 37/231
9,820,437 B2 * 11/2017 Hoppel ..... A01D 43/12
2004/0006894 A1 1/2004 Schultz et al.
2004/0060201 A1 4/2004 Schultz et al.
2006/0096133 A1 5/2006 Sanders et al.
2007/0256846 A1 11/2007 Gibbs
2009/0105911 A1 4/2009 Okeson et al.
2010/0164202 A1 7/2010 Dilworth et al.
2011/0203816 A1 * 8/2011 Hurley ..... A01B 45/02 172/21
2015/0007542 A1 1/2015 Oswald et al.
2021/0079611 A1 3/2021 Saranzak et al.

OTHER PUBLICATIONS

Boss Snowplow, 2019 Compact Vehicle Equipment Snowplows & Spreaders Brochure, As early as 2019, 9 pgs.

* cited by examiner

*Primary Examiner* — Adam J Behrens
*Assistant Examiner* — Robert E Pezzuto
(74) *Attorney, Agent, or Firm* — Taft Stettinius & Hollister LLP

(57) ABSTRACT

An apparatus for attaching a snow plow to the front of a work machine includes a first beam extending in a first longitudinal direction. A first hinge member is coupled with the first beam. A second beam is coupled with the first beam and extends rearward in a second longitudinal direction angled upward relative to the first beam member. A second hinge member coupled with the second beam. A bracket is positioned upward of the second hinge member and is coupled with a third hinge member. A fourth hinge member is coupled with the first beam or the second beam. An actuator is rotatably coupled with the third hinge member and the fourth hinge member and is adjustable to vary the position of the first beam and the second beam relative to the upper bracket with the upper bracket maintained in a fixed position.

18 Claims, 10 Drawing Sheets

SNOWPLOW HOOKUPS FOR WORK MACHINES

CROSS REFERENCE

The present application claims the benefit of and priority to U.S. Application No. 63/069,326 filed Aug. 24, 2020 the disclosure of which is hereby incorporated by reference.

BACKGROUND

The present disclosure relates to snowplow hookups for work machines. A number of snowplow attachments for work machines have been proposed. Heretofore, such proposals have suffered from a number of disadvantages, drawbacks, limitations, and shortcomings. A number of snowplow attachments are incompatible with certain classes and types of work machines. For example, some such snowplow attachments are sufficiently heavy as to be incompatible with light-duty work machines. Additionally, some such snowplow attachments require work machines with particular attachment, coupling, or mounting mechanisms, for example, front loader arm mounts, three-point mounts, four points mounts, or other conventional attachment, coupling, or mounting mechanisms. Some such snowplow attachments require attachment at particular locations which interfere with the operation of some work machines. For example, some such snowplow attachments require attachment at locations positioned or spaced apart such that they interfere with the wheels of ground contacting members of certain work machines. Some such snowplow attachments require attachment at locations at or on a front or forward-facing structure of a work machine. Some such snowplow attachments inhibit and limit the maneuverability of a work machine with which they are coupled. Some such snowplow attachments inhibit and limit visibility or field of vision available to an operator operating a work machine with which they are coupled. As indicated by these and other disadvantages, drawbacks, limitations, and shortcomings, there remains a substantial need for the unique apparatuses, systems, and methods disclosed herein.

DISCLOSURE OF EXAMPLE EMBODIMENTS

For the purposes of clearly, concisely and exactly describing example embodiments of the present disclosure, the manner, and process of making and using the same, and to enable the practice, making and use of the same, reference will now be made to certain example embodiments, including those illustrated in the figures, and specific language will be used to describe the same. It shall be understood that no limitation of the scope of the invention is thereby created and that the invention includes and protects such alterations, modifications, and further applications of the example embodiments as would occur to one skilled in the art.

SUMMARY

One non-limiting example embodiment comprises a unique snowplow hookup for coupling a snowplow attachment and a work machine. The snowplow hookup may comprise a structural combination including one or more of a first beam extending in a first longitudinal direction, a first hinge member coupled with the first beam, a second beam coupled with the first beam and extending rearward in a second longitudinal direction angled upward relative to the first beam member, a second hinge member coupled with the second beam, a bracket positioned upward of the second hinge member and coupled with a third hinge member, a fourth hinge member coupled with the first beam or the second beam, and actuator rotatably coupled with the third hinge member and the fourth hinge member and adjustable to vary the position of the first beam and the second beam relative to the upper bracket with the upper bracket maintained in a fixed position. In certain embodiments, an apparatus or a system includes such a unique snowplow hookup. In certain embodiments, an apparatus or a system includes such a unique snowplow hookup operatively coupled with a work machine. In certain embodiments, an apparatus or a system includes such a unique snowplow hookup operatively coupled with a snowplow attachment. In certain embodiments, an apparatus or a system includes such a unique snowplow hookup operatively coupled with a work machine and operatively coupled with a snowplow attachment. Other embodiments, forms, objects, features, advantages, aspects, and benefits shall become apparent from the following description and drawings.

DETAILED DESCRIPTION OF EXAMPLE EMBODIMENTS

Figure 1:
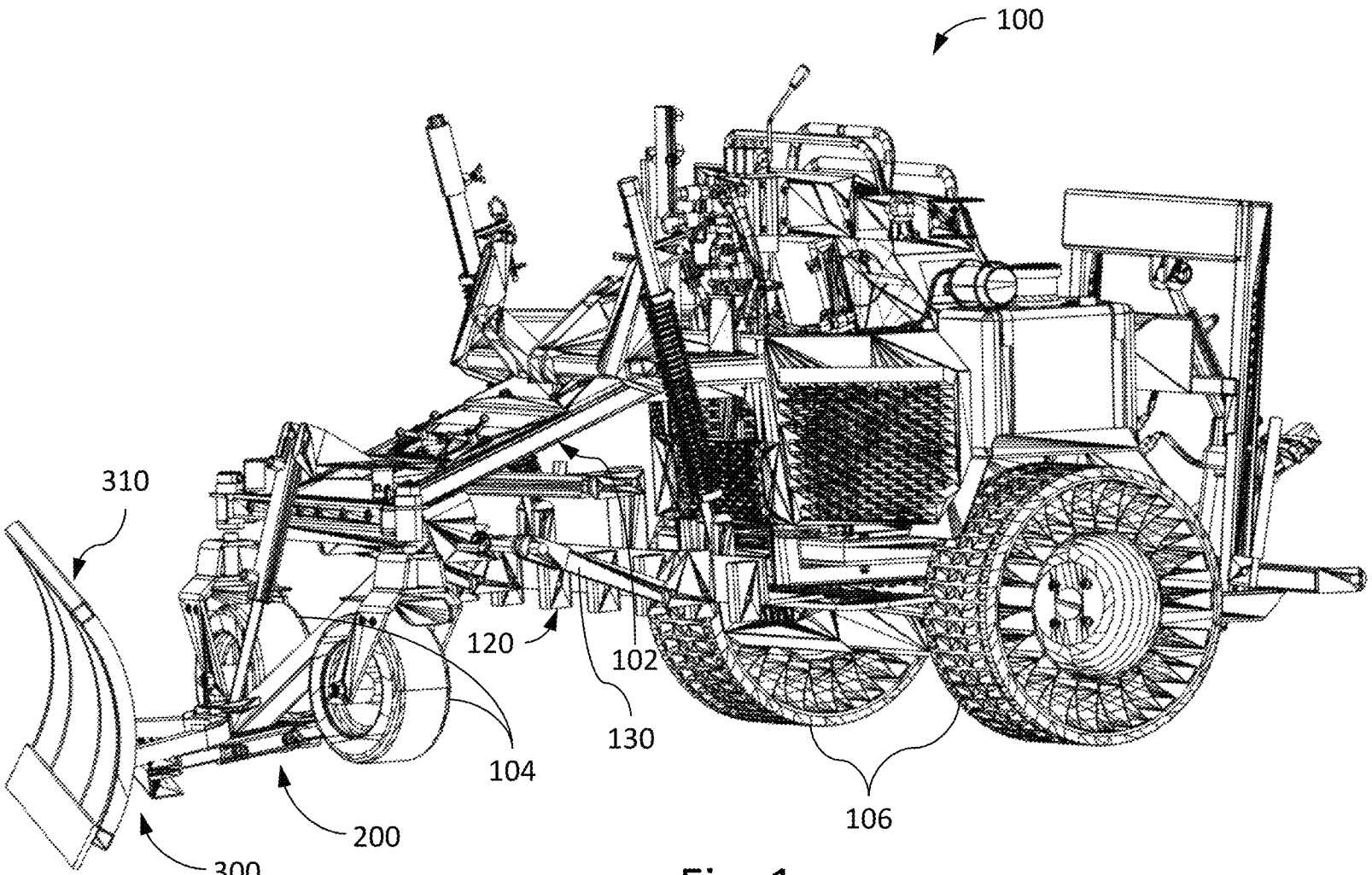
FIG. 1 is a perspective view illustrating certain aspects of a system including a snowplow hookup coupling a snowplow attachment and a work machine.
Figure 2:
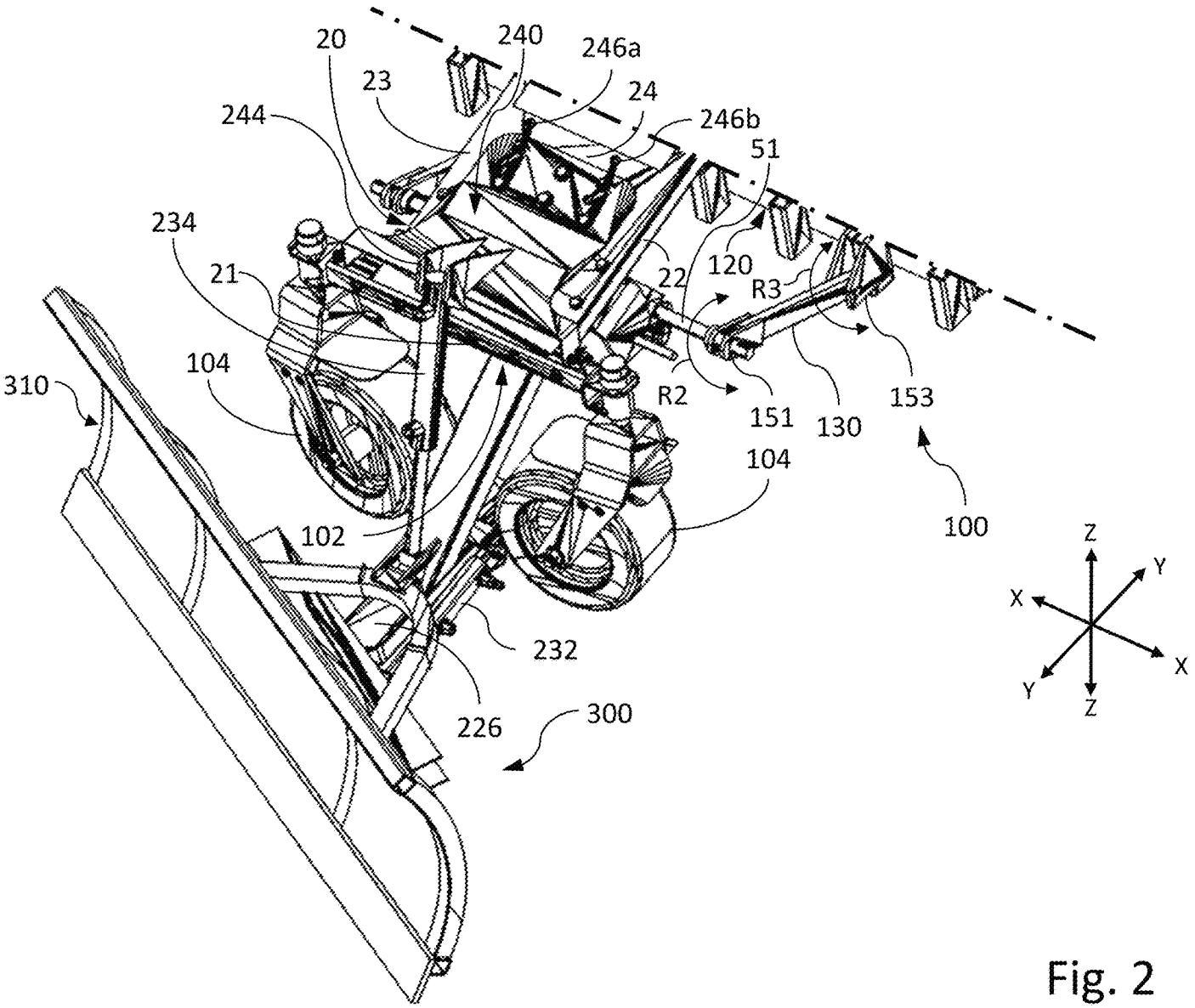
FIG. 2 is another perspective view of a portion of the system of FIG. 1.
Figure 3:
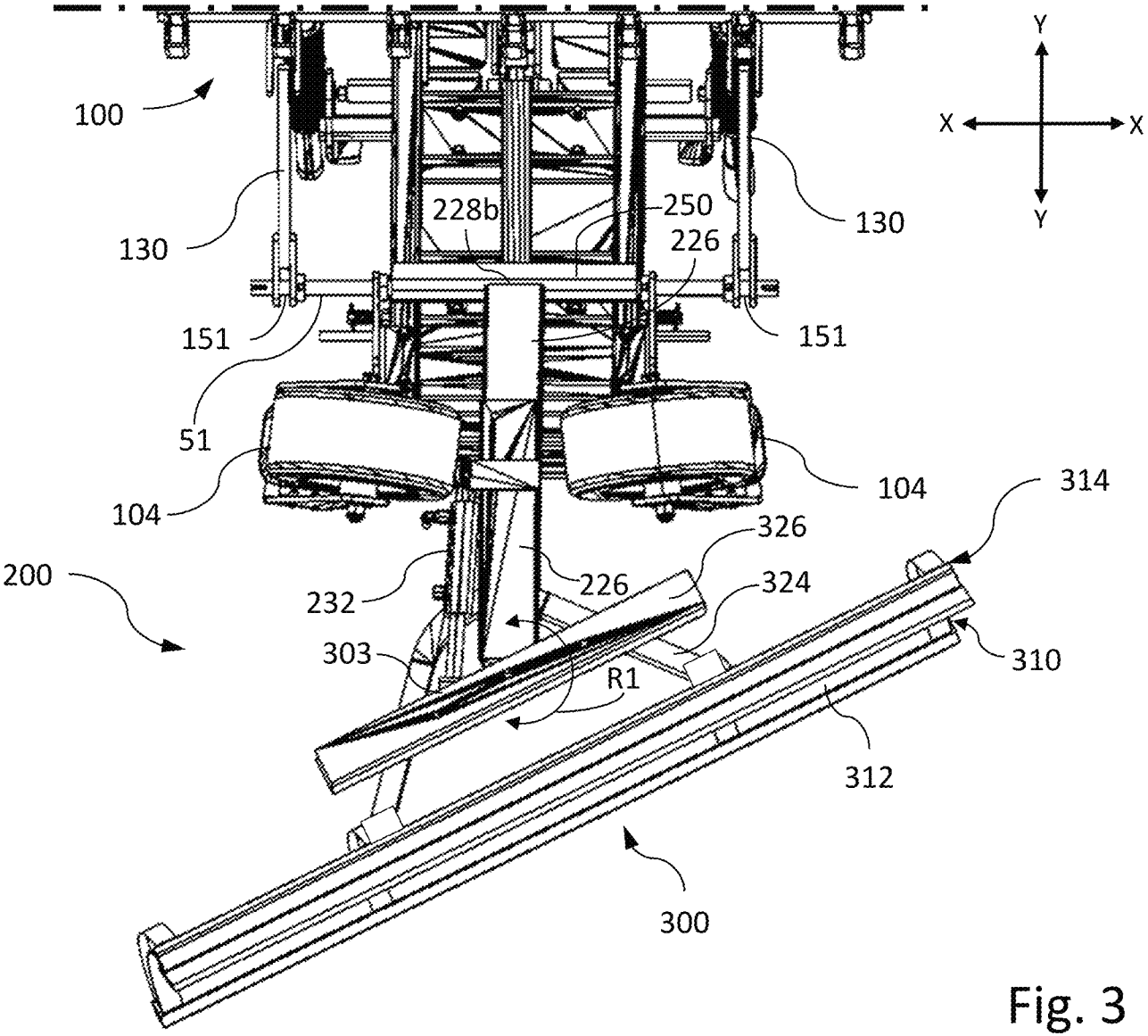
FIG. 3 is a bottom view of a portion of the system of FIG. 1.
Figure 4:
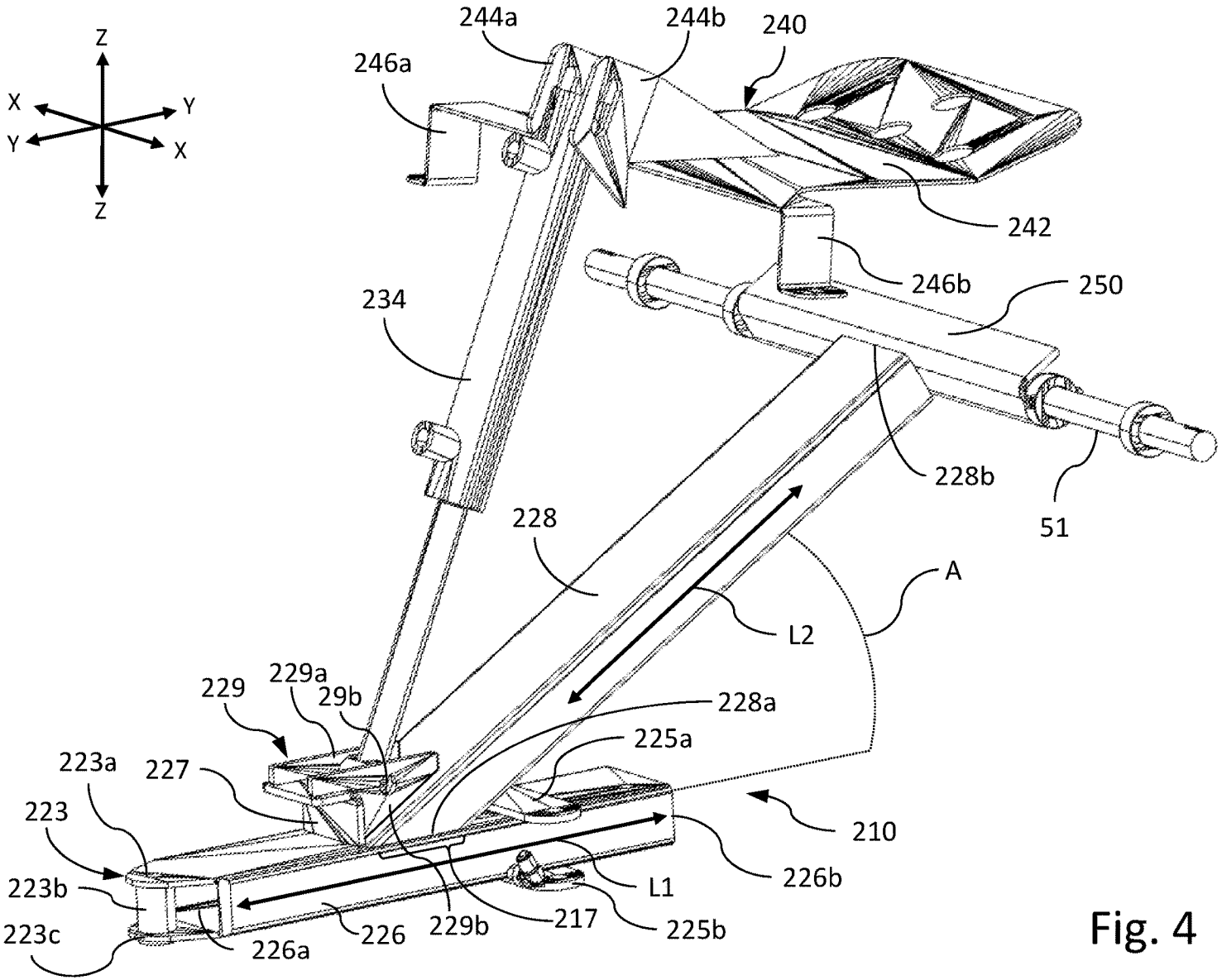
FIG. 4 is a perspective view illustrating certain aspects of the snowplow hookup of FIG. 1.
Figure 5:
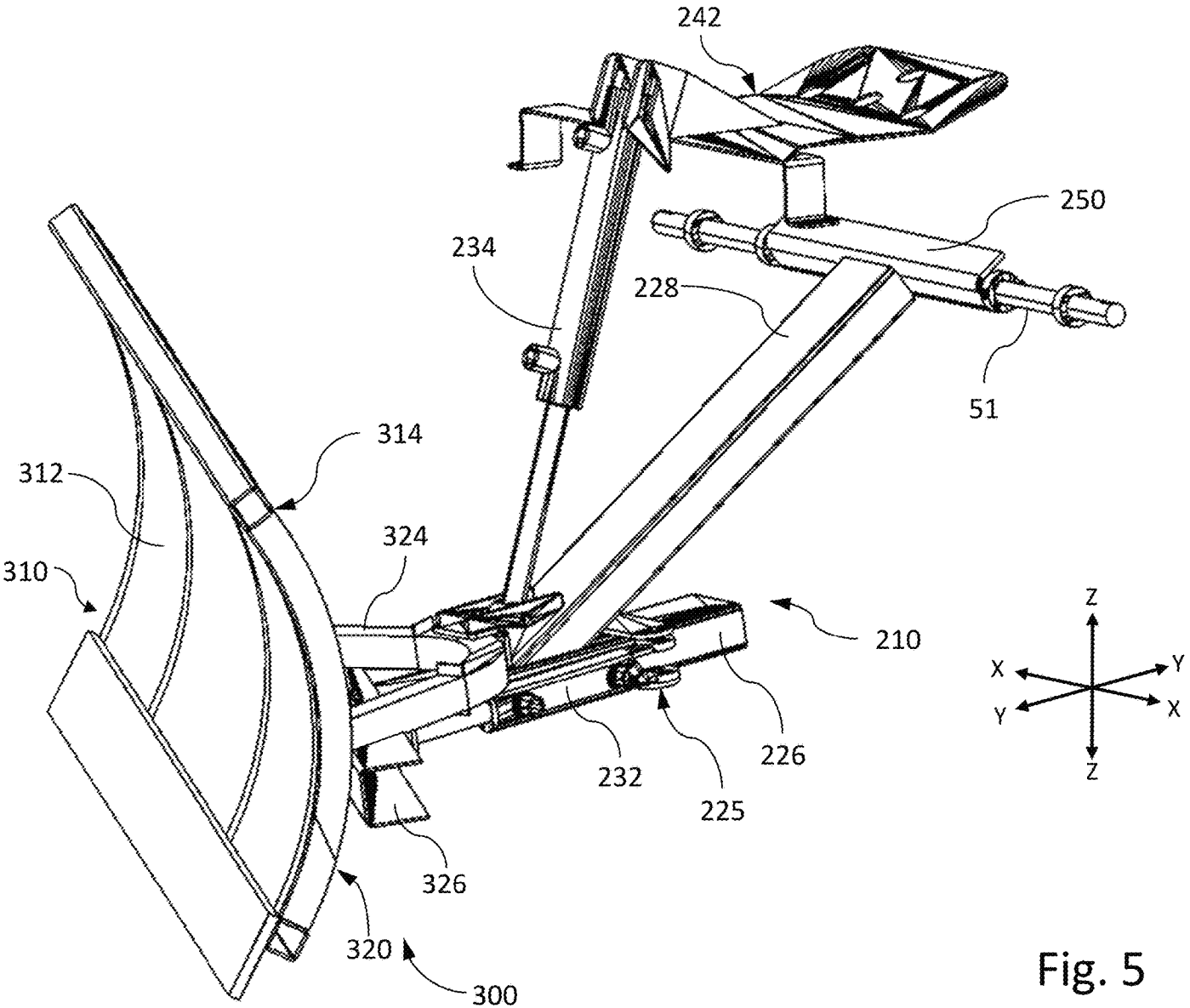
FIG. 5 is a perspective view illustrating certain aspects of the snowplow attachment and snowplow hookup of FIG. 1.
Figure 6:
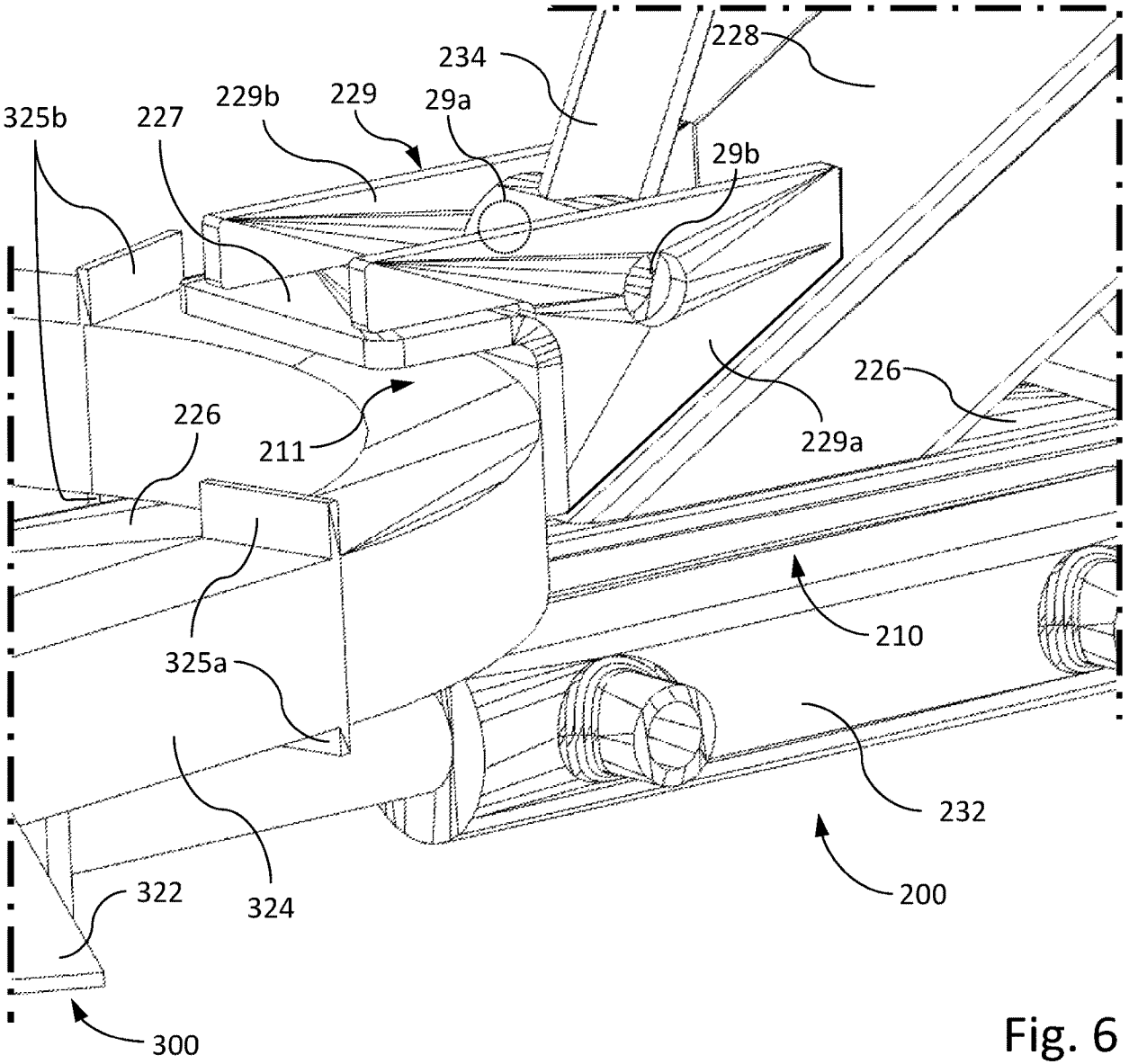
FIG. 6 is a detailed perspective view of a portion of the snowplow attachment and snowplow hookup of FIG. 1.
Figure 7:
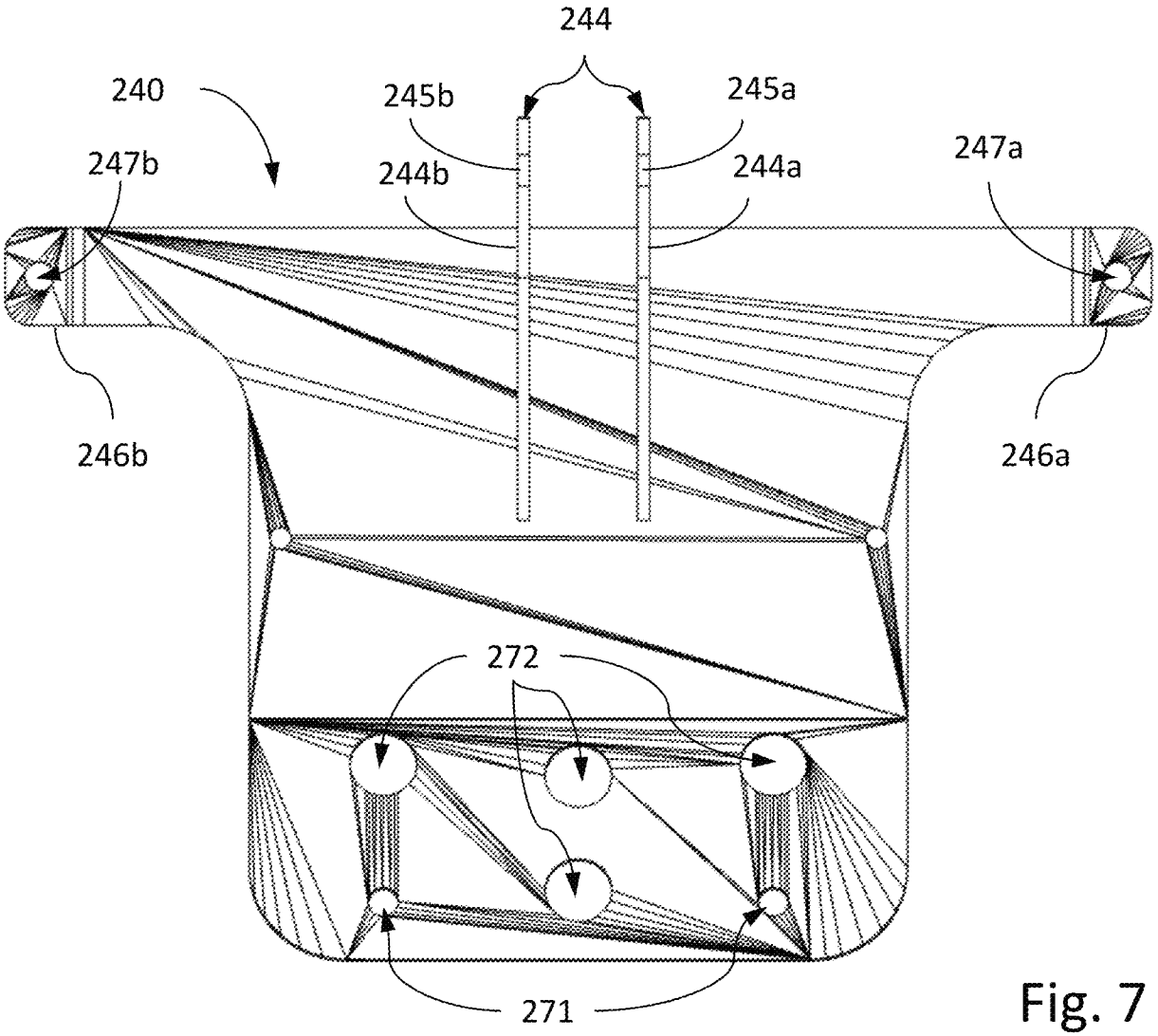
FIGS. 7, 8, and 9 are a top view, end view, and side view, respectively, illustrating certain aspects of a bracket of the snowplow hookup of FIG. 1.
Figure 8:
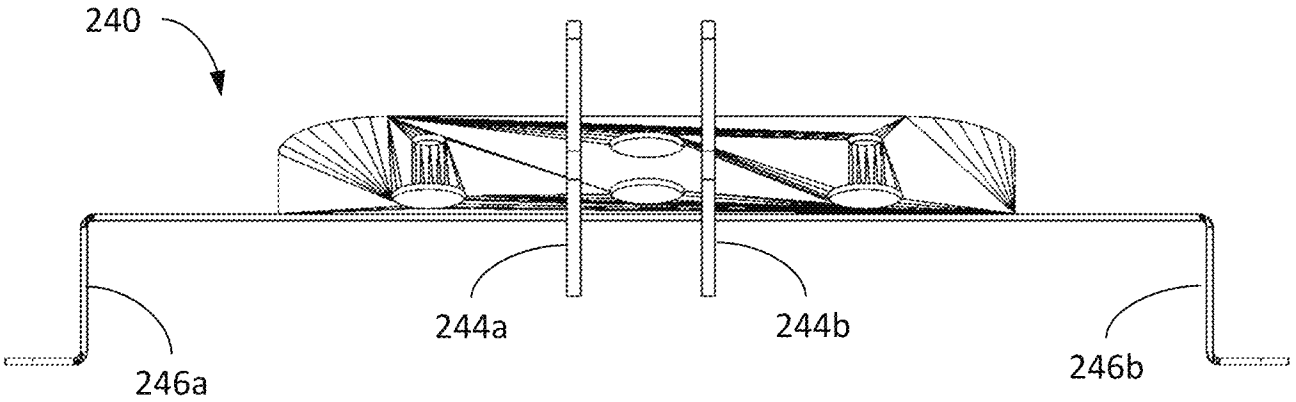
Figure 9:
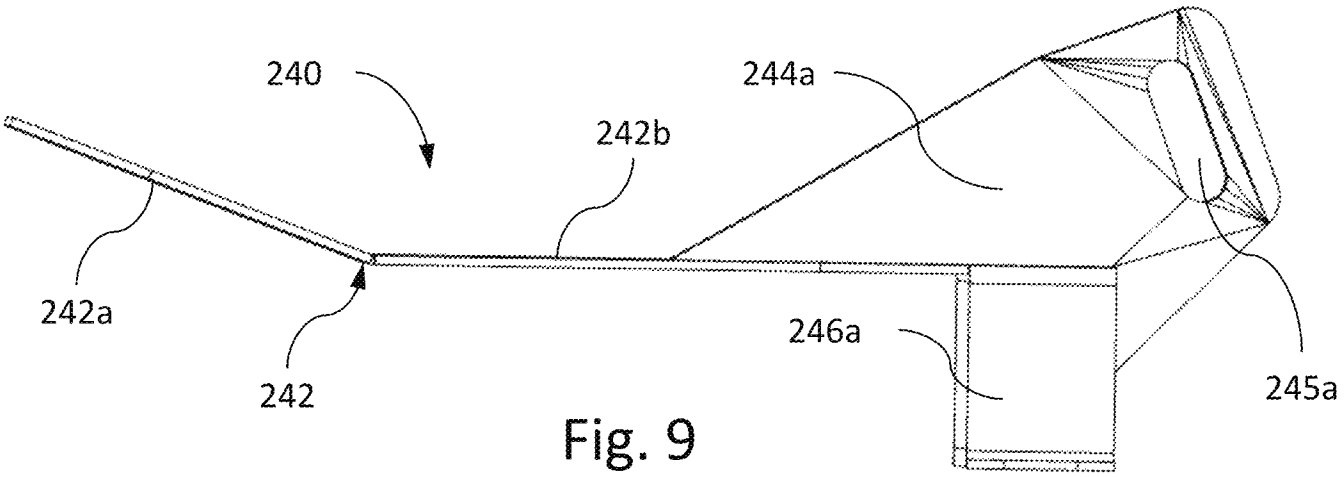
Figure 10:
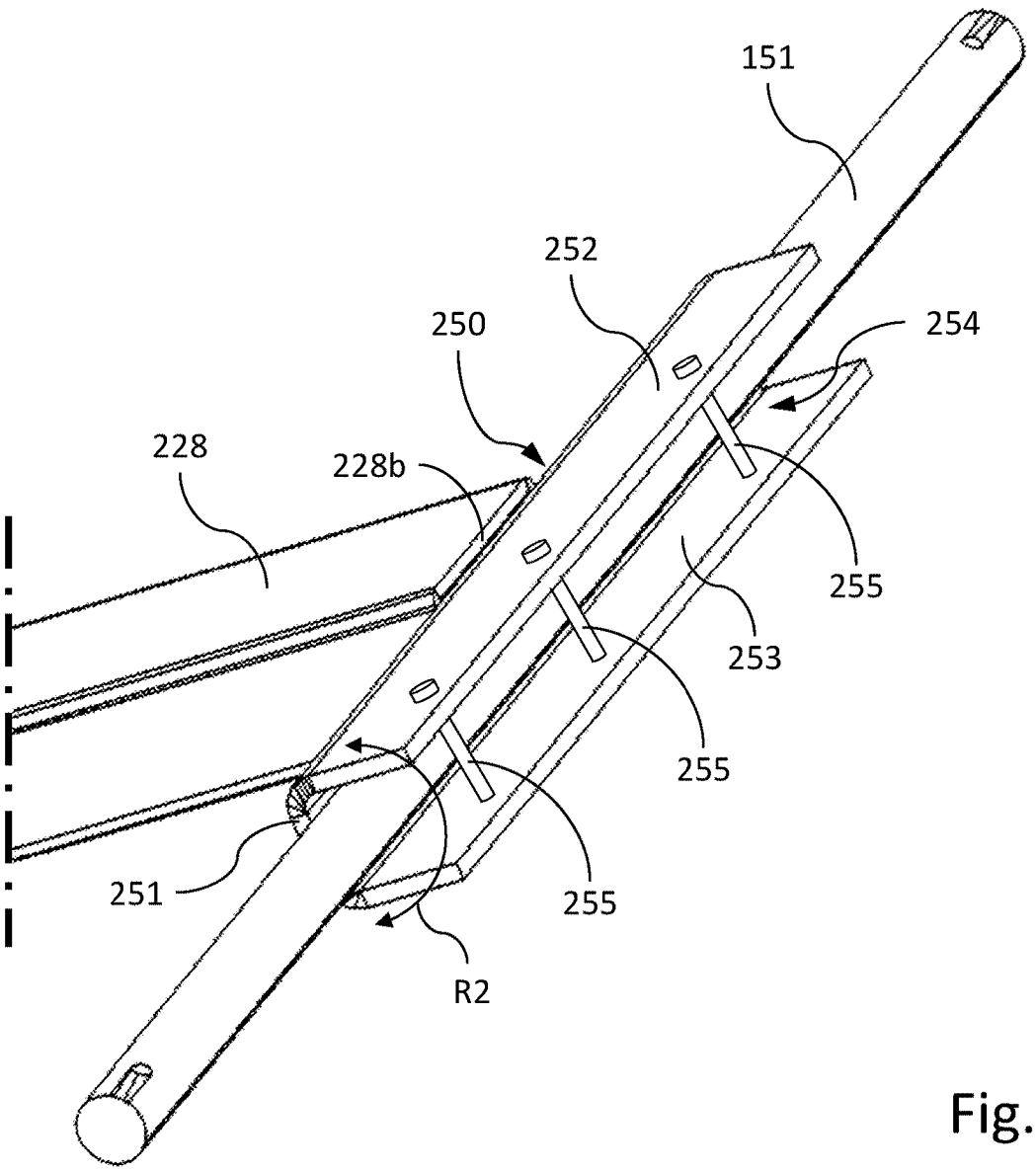
FIG. 10 is a perspective view illustrating certain aspects of a bracket of the snowplow hookup of FIG. 1.
Figure 11:
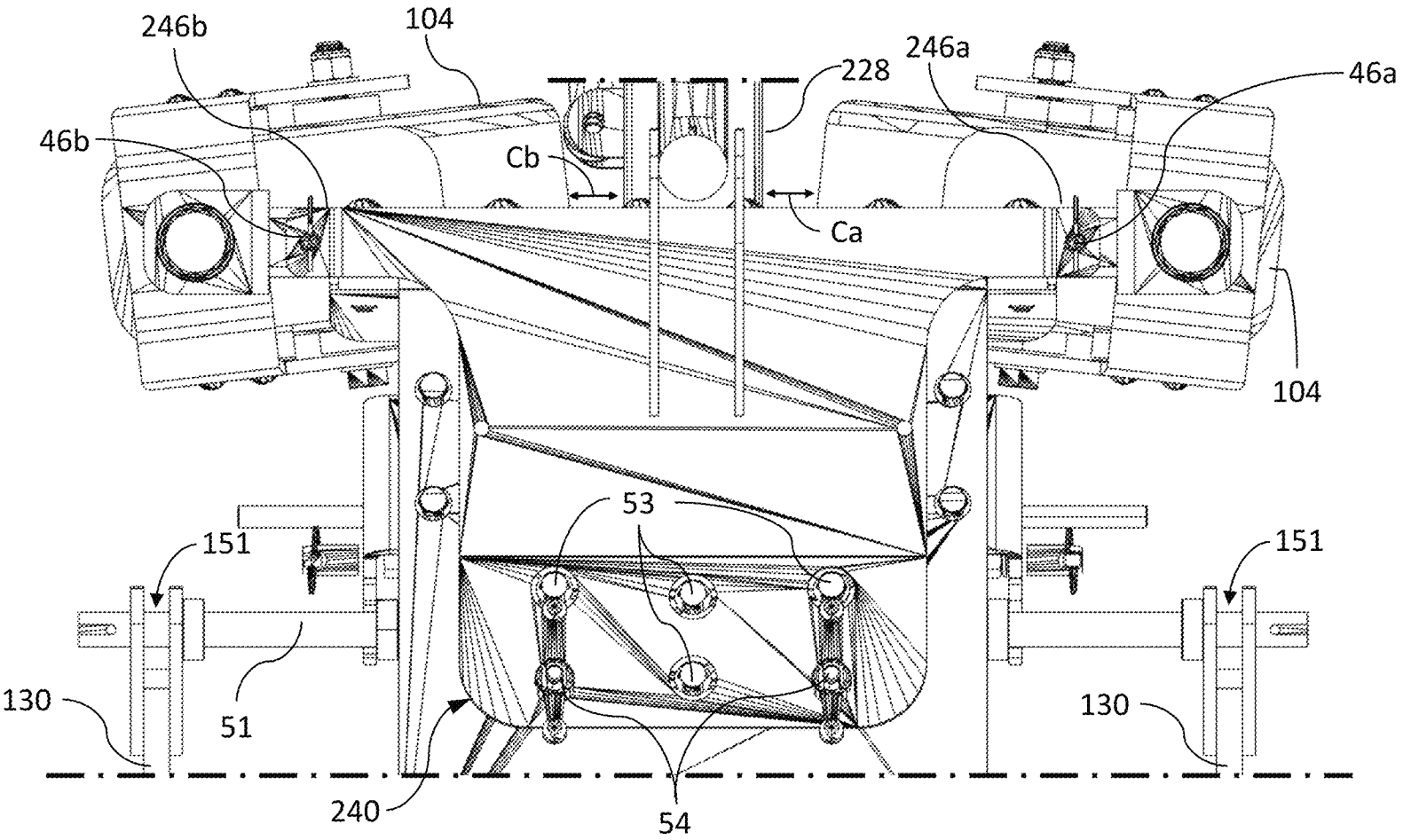
FIG. 11 is a top view illustrating certain aspects of a portion of the snowplow hookup and work machine of FIG. 1.

Referring now to the figures and with initial reference to FIG. 1, there is illustrated an example system including a snowplow hookup 200 operatively coupled with a work machine 100 and a snowplow assembly 300 which, in turn, are attached to and coupled with one another by the snowplow hookup 200. It shall also be appreciated that snowplow hookup 200 may also be referred to herein as plow hookup 200, or hookup 200. It shall be appreciated that the work machine 100 may also be referred to herein as machine 100. It shall be further appreciated that snowplow assembly 300 may also be referred to herein as plow assembly 300, or assembly 300. It shall be appreciated that number of structural components or elements disclosed herein are described as being attached, coupled, or joined to one another or as attaching, coupling, or joining other structural components or elements which shall be understood to encompass a number of attachment, coupling, or joining structures and techniques, for example, adhesion, bolting, bonding, brazing, clamping, formation as an integral or unitary structure with coupled portions, screwing, riveting, welding or other attachment, coupling or joining techniques as will occur to one of skill in the art with the benefit of the present disclosure except as otherwise expressly or logically limited or excluded. The assemblies of components disclosed herein are likewise understood to encompass such attachment or coupling structures and techniques except as otherwise expressly or logically limited or excluded.

In the illustrated embodiment, the work machine 100 is a self-propelled, zero-turn radius work machine. In certain forms, the work machine 100 may be configured as a zero-turn radius work machine as described in U.S. Pat. Nos. 9,332,687 and 9,883,621 the disclosures of which are incorporated herein by reference. In other embodiments, various other types of work machines may be utilized. In certain preferred forms, work machine 100 is configured and provided as a light-duty work machine having a nominal or base weight of 1300 pounds +/−10% and a loaded weight (including the weight of a plow attachment and salt) of 1750 pounds +/−10%. In other preferred forms, work machine 100 may be configured and provided as a light-duty work machine having a nominal or base weight of 2000 pounds or less, 1500 pounds or less, or 1000 pounds or less).

Work machine 100 includes a chassis 102 supported by front wheels 104 and rear wheels 106 which contact an underlying ground surface (not depicted in the illustrated views) and support chassis 102. The chassis 102 includes a front chassis section 20 comprising a forward lateral frame member 21, longitudinal upright frame members 22, 23, and front plate member 24 which are arranged and oriented to provide a generally rectilinear upper front surface and supporting frame oriented at an upward angle relative to the X-Y plane of the illustrated X-Y-Z coordinate system.

Chassis 102 is coupled with and carries an adjustable, suspension-mounted, under-belly tool assembly 120 which is coupled with pulling linkages 130 at pivotal couplings 153. The tool assembly 120 is adjustable to rotate or pivot relative to the pulling linkages 130 generally in the directions indicated by arrow R3. Pulling linkages 130 are further coupled with a lateral member provided in the form of a connecting rod 51 at pivotal coupling 151 allowing rotation of the pulling linkages substantially in the directions indicated by arrow R2. The connecting rod 51 is coupled with the chassis 102 and extends laterally along the width of the work machine 100 in the X-axis direction. The connecting rod 51 also serves as a hinge member for coupling with the hookup 200.

The hookup 200 comprises a first beam 226 extending from a forward end 226*a* to a rearward end 226*b* in a first longitudinal direction parallel to the X-Y plane of the illustrated X-Y-Z coordinate system indicated by arrow L1. A first hinge member 223 is coupled with the first beam 226 at the forward end 226*a*. In the illustrated embodiment, the first hinge member 223 includes upper and lower eye members 223*a*, 223*c*, and a bushing 223*b* which are adapted and configured to couple with a corresponding hinge member of plow assembly 300. Other embodiments contemplate other structures and types of hinge members adapted and configured to couple with a corresponding hinge member of plow assembly 300.

A second beam 228 is coupled with the first beam 226 at a coupling location 217 rearward of the forward end 226*a*. The coupling of the first beam 226 and the second beam 228 may comprise one or more of welding, brazing, bolting, clamping, adhesive coupling, formation as an integral or unitary structure with coupled portions, or other coupling or joining techniques as will occur to one of skill in the art with the benefit of the present disclosure. It shall be appreciated that other structures described or referred to herein as being coupled also encompass this range of coupling techniques and coupled states. The second beam 228 extends from a forward end 228*a* to a rearward end 228*b* in a second longitudinal direction indicated by arrow L2 angled upward relative to the X-Y plane as indicated by angle A. The angle A is a about 30 degrees in the illustrated embodiment. In other embodiments, the angle A may be in the range of 25 degrees to 35 degrees or other ranges.

In the illustrated embodiment, the first beam 226 and the second beam 228 are configured and provided as metal (e.g., steel) beams of a tubular type. It shall be appreciated that a number of other configurations, shapes, and types of beams may also be utilized including, without limitation, solid beam members, bar members, angle beam members (e.g., beam members including first and second portions oriented at 90 degrees relative to one another or at other relative angular orientations), beam members having a round, circular, annular, C-shaped, D-shaped, H-shaped, I-shaped, J-shaped, L-shaped, T-shaped, U-shaped, axial cross-section, or other shapes of axil cross-sections as will occur to one of skill in the art. It shall also be appreciated that other structural components disclosed herein including frame components, members, or structures, likewise encompass such configurations, shapes, and types. It shall be further appreciated that a number of types of beams materials may be utilized including, without limitation, aluminum, composites, laminates, or other types and other suitable materials as will occur to one of skill in the art with the benefit of the present disclosure.

A second hinge member 250 is coupled with the rearward end 228*b* of the second beam 228 and is rotatably coupled with the connecting rod 51 which serves as a hinge member fixedly coupled with the chassis 102 of the work machine 100. In the illustrated embodiment, the second hinge member 250 is provided and configured as an elongate bracket having a side portion 251, upper and lower portions 252, 253 extending generally parallel away from the side portion 251, and an open side opposite the side portion which define a channel 254 in which the connecting rod 51 is received.

Pins 255 or other fasteners (e.g., bolts, screws, clips, rods, or the like) are inserted into and pass through openings in upper and lower portions 252, 253 and retain the connecting rod 51 in the channel 254 of the second hinge member 250 by at least partially obstructing egress from the channel. In the illustrated embodiment, the connecting rod 51 extends substantially across the width of the front section 20 of chassis 102. In the illustrated embodiment, the second hinge member 250 is provided and configured as an elongate bracket with a generally rectangular axial cross-section. In other embodiments, other types and configurations of hinge members may be utilized including, for example, brackets or other hinge members with arcuate or curved cross-sections (e.g., U-shaped, C-shaped, or, D-shaped cross-sections), V-shaped cross-sections, or other configurations, shapes and types of hinges as will occur to one of skill in the art with the benefit of the present disclosure.

A bracket 240 is positioned upward in the Z-axis direction of the second hinge member 250 and the second beam 228. The bracket 240 includes first plate portion 242*a* having a first plurality of apertures 272 and a second plurality of apertures 271 provided therein. The first plurality of apertures 272 are configured and sized to receive alignment studs 53 which are provided on the upper surface of the front plate member 24 of front section 20 of chassis 102. The second plurality of apertures 271 are configured and sized to receive bolt members to which nut members 54 are threadedly coupled to retain the bracket 240 in place relative to the front plate member 24 of front section 20 of chassis 102.

The bracket 240 includes second plate portion 242*b* which extends at an angle from the first plate portion 242*a*. The bracket 240 includes further include foot portions 246*a*, 246*b* (also referred to herein as feet 246*a*, 246*b*) coupled with and extending downward from the second plate portion 242*b*. The foot portions 246*a*, 246*b* round apertures 247*a*, 247*b* formed therein. The round apertures 247*a*, 247*b* are configured and sized to receive bolt members to which nut members 46*a*, 46*b* are threadedly coupled to retain the bracket 240 in place relative to the front section 20 of chassis 102.

A third hinge member 244 including slotted ears 244*a*, 244*b* is coupled with the bracket 240. Slotted ears 244*a*, 244*b* have slot-shaped apertures 245*a*, 245*b* provided therein. An actuator 234 is rotatably coupled with the third hinge member 244 by a coupling a pin or axle (not illustrated) which passes through and is retained in the slot-shaped apertures 245*a*, 245*b* of third hinge member 244. In the illustrated embodiment, the actuator 234 is configured and provided as a dual-action hydraulic cylinder and piston which can be controlled by an operator to axially extend or contract. Other embodiment may additionally or alternatively include other types of actuators including, for example, electric motor arrangements, screw drives, linear actuators, or combinations of these and other types of actuators as will occur to one of skill in the art with the benefit of the present disclosure.

The slot-shaped apertures 245*a*, 245*b* provide a degree of play or float for the actuator 234 and the plow hookup 200 and plow assembly 300 which when coupled therewith. The play or float slot-shaped apertures 245*a*, 245*b* provides unanticipated benefits including permitting the plow hookup 200 and plow assembly 300 to track variations in an underlying ground surface which is being plowed and mitigating the possibility that the plow assembly will jam against the underlying ground surface.

The actuator 234 is also rotatably coupled with a hinge member 229. The hinge member 229 includes eyehole ears 229*a*, 229*b* which are coupled the second beam 228, angle member 227, and the first beam 226. In the illustrated embodiment, the eyehole ears 229*a*, 229*b* of hinge member 229 are welded to the second beam 228 and the angle member 227 is welded to the first beam 226 and the hinge member 229. In other embodiments, these structures may be differently coupled with one another including, for example, via the other coupling techniques described herein. The eyehole ears 229*a*, 229*b* have round apertures 29*a*, 29*b* provided therein. The actuator 234 is rotatably coupled with the hinge member 229 by a coupling pin or axle (not illustrated) which passes through and is retained in the round apertures 29*a*, 2*b* of the hinge member 229. The actuator 234 is adjustable to vary the position of the first beam 226 and the second beam 228 relative to the upper bracket 240 with the upper bracket 240 fixedly coupled with the front chassis section 20 such that the upper bracket 240 is maintained in a fixed position.

The angle member 227 and the first beam 226 define a receiving slot 211 which slidably receives an angled frame member 324 of the plow attachment 300 which slides within the receiving slot 211 as the snowplow attachment rotates relative to the snowplow hookup 200. The angled frame member 324 includes stop members 325*a*, 325*b* which limit rotation of the angled frame member 324 in the receiving slot 211 when the angled frame member 324 rotates to an extent that one of stop members 325*a*, 325*b* comes into contact with the angle member 227, the first beam 226, or both.

The plow attachment 300 includes a plow 310 assembly fixedly coupled with a supporting frame 320. The plow assembly 310 includes a plow blade 312 supported by a blade frame 314 which includes frame members extending generally along the perimeter of the rear surface of the plow blade 312 and centrally positioned frame members following the curved contour of the rear surface of the plow blade 312. The plow attachment 300 further includes an angled frame member 324 and a lateral frame member 326. The angled frame member 324 is coupled with the blade frame 314 and with the lateral frame member 326. The lateral frame member includes a hinge member which is coupled with the first hinge member 223 and is rotatable relative to the plow hookup 200 in the direction generally indicated by arrow R1.

An actuator 232 is rotatably coupled with a hinge member 225 of the plow hookup 200 by a coupling pin or axle (not illustrated) which passes through and is retained in apertures provided in eyehole ears 225*a*, 225*b* which, in turn, are coupled the first beam 226. The actuator 232 is also rotatably coupled with a hinge member 303 of the plow hookup 200 by a coupling pin or axle (not illustrated) which passes through and is retained in apertures provided in the first bean 226. The actuator 232 is adjustable to rotate the plow attachment 300 relative to the plow hookup 200.

In the illustrated example, the dimensions and coupling locations of the hookup 200 (e.g., the length of the hookup 200 in the X-Y direction intermediate the coupling location of the hookup 200 with the plow attachment 300 and the lower coupling location of the hookup 200 with the vehicle 100, the position of the lower coupling location, and the position of the upper coupling location of the hookup 200 with the vehicle 100) are preferably selected to provide adjustability, center of mass, mechanical advantage, and other characteristics enhancing a number of snow removal operations. In one aspect, the dimensions and coupling locations of the hookup 200 are such that the hookup 200 is adjustable to vary the angle of the lift the plow attachment 300 eighteen (18) inches or more above an underlying ground surface. Such adjustment enhances the working height of the plow attachment 300, for example, to provide higher stacking heights of snow and ice.

In another aspect, the dimensions and coupling locations of the hookup 200 are such that, during plowing operation, the coupling locations between the hookup 200 and the vehicle 100 apply force to the vehicle 100 rearward of the front wheels 104. Such positioning enhances the center of mass positioning of the hookup 200 providing improved plow capacity relative to more forward coupling locations. Such positioning also enhances the mechanical advantage which the actuator 234 can operate to lift the plow attachment 300.

In a further aspect, the dimensions and coupling locations of the hookup 200 are such that they facilitate simple attachment and detachment of the hookup 200 and the work machine 100.

While example embodiments of the disclosure have been illustrated and described in detail in the drawings and foregoing description, the same is to be considered as illustrative and not restrictive in character, it being understood that only certain example embodiments have been shown and described and that all changes and modifications that come within the spirit of the claimed inventions are desired to be protected. It should be understood that while the use of words such as preferable, preferably, preferred or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A system for attaching a snowplow in front of a work machine, the system comprising:

a snowplow hookup including a first beam extending from a first forward end to a first rearward end in a first longitudinal direction parallel to an X-Y plane of an X-Y-Z coordinate system;

a first hinge member coupled with the first beam at the first forward end;

a second beam coupled with the first beam at a coupling location rearward of the first forward end and extending from the coupling location to a second rearward end in a second longitudinal direction angled upward relative to the X-Y plane;

a second hinge member coupled with the second beam at the second rearward end;

a bracket positioned upward of the second hinge member in a Z-axis direction of the X-Y-Z coordinate system;

a third hinge member coupled with the bracket;

a fourth hinge member coupled with at least one of the first beam and the second beam; and an actuator rotatably coupled with the third hinge member and the fourth hinge member, the actuator being adjustable to vary a position of the first beam and the second beam relative to the bracket with the bracket maintained in a fixed position;

wherein the bracket is coupled with the work machine and includes a first plate portion having a plurality of apertures and a plurality of alignment features extending upward from an upper surface of a forward portion of the work machine are received in the plurality of apertures.

2. The system of claim 1 wherein the second hinge member is coupled with a lateral member of the work machine extending laterally along a width of the work machine.

3. The system of claim 2 wherein the second hinge member comprises an elongate bracket having a channel in which the lateral member is received.

4. The system of claim 3 wherein the lateral member comprises a rod having a round cross-section.

5. The system of claim 4 wherein the rod is retained in the channel by a plurality of fasteners coupled with the elongate bracket and at least partially obstructing egress from the channel.

6. The system of claim 2 wherein the lateral member of the work machine is one or both of positioned below a frame of the work machine and positioned rearward of forward rotatable ground contacting members of the work machine.

7. The system of claim 2 wherein the second hinge member extends over a width of a front frame portion of the work machine.

8. The system of claim 1 wherein the bracket is coupled with an upper surface of a forward portion of the work machine.

9. The system of claim 1 wherein the bracket is positioned upward and rearward of forward rotatable ground contacting members of the work machine.

10. The system of claim 1 wherein the bracket includes a second plate portion positioned at an angle relative to the first plate portion and a plurality of feet extending downward from the second plate portion.

11. The system of claim 10 wherein the plurality of feet are coupled with the forward portion of the work machine by respective ones of a second plurality of nut and bolts members.

12. The system of claim 1 comprising a snowplow assembly rotatably coupled with the snowplow hookup at an assembly-hookup hinge.

13. The system of claim 12 wherein the snowplow assembly includes a curved frame member extending rearward of the assembly-hookup hinge.

14. The system of claim 13 wherein the curved frame member is received in a slot defined by the snowplow hookup.

15. The system of claim 14 wherein the slot is defined by an angle member and a portion of the first beam.

16. A system comprising:

a snowplow hookup including a first beam extending from a first forward end to a first rearward end in a first longitudinal direction parallel to an X-Y plane of an X-Y-Z coordinate system;

a first hinge member coupled with the first beam at the first forward end;

a second beam coupled with the first beam at a coupling location rearward of the first forward end and extending from the coupling location to a second rearward end in a second longitudinal direction angled upward relative to the X-Y plane;

a second hinge member coupled with the second beam at the second rearward end;

a bracket positioned upward of the second hinge member in a Z-axis direction of the X-Y-Z coordinate system, the bracket including a first plate portion contacting and supported by a front plate member of the work machine, the front plate member being angled upward relative to the X-Y plane;

a third hinge member coupled with the bracket;

a fourth hinge member coupled with at least one of the first beam and the second beam; and an actuator rotatably coupled with the third hinge member and the fourth hinge member, the actuator being adjustable to vary a position of the first beam and the second beam relative to the bracket with the bracket maintained in a fixed position;

wherein the first plate portion comprises a plurality of apertures and a plurality of alignment features extending upward from an upper surface of the front plate member of the work machine are received in the plurality of apertures.

17. The system of claim 16, wherein the bracket includes a second plate portion positioned at an angle relative to the first plate portion and a plurality of feet extending downward from the second plate portion.

18. The system of claim 17 wherein the plurality of feet are coupled with the forward portion of the work machine by respective ones of a second plurality of nut and bolts members.

* * * * *